US008095027B2

(12) United States Patent
Mori et al.

(10) Patent No.: US 8,095,027 B2
(45) Date of Patent: Jan. 10, 2012

(54) IMAGE FORMING DEVICE AND PROCESS CARTRIDGE

(75) Inventors: Keitaro Mori, Kanagawa (JP); Ryosaku Igarashi, Kanagawa (JP); Yasuaki Watanabe, Kanagawa (JP)

(73) Assignee: Fuji Xerox Co., Ltd., Toyko (JP)

( * ) Notice: Subject to any disclaimer, the term of this patent is extended or adjusted under 35 U.S.C. 154(b) by 646 days.

(21) Appl. No.: 12/210,398

(22) Filed: Sep. 15, 2008

(65) Prior Publication Data

US 2009/0245874 A1 Oct. 1, 2009

(30) Foreign Application Priority Data

Mar. 27, 2008 (JP) ..... 2008-083110

(51) Int. Cl.
*G03G 15/10* (2006.01)

(52) U.S. Cl. ..... 399/57

(58) Field of Classification Search ..... 399/237, 399/239, 245, 57
See application file for complete search history.

(56) References Cited

U.S. PATENT DOCUMENTS 6,108,508 A * 8/2000 Takeuchi et al. ..... 399/238
2004/0005510 A1* 1/2004 Asami et al. ..... 430/114
2004/0146317 A1* 7/2004 Park ..... 399/237

FOREIGN PATENT DOCUMENTS

| | | |
|---|---|---|
| JP | 5-87834 | 9/1991 |
| JP | 5-16515 | 1/1993 |
| JP | 5-188827 | 7/1993 |
| JP | 6-4008 | 1/1994 |
| JP | 9-156150 | 6/1997 |

* cited by examiner

*Primary Examiner* — David Gray
*Assistant Examiner* — Barnabas Fekete
(74) *Attorney, Agent, or Firm* — Fildes & Outland, P.C.

(57) ABSTRACT

An image forming device contains: a latent image holding member; a latent image forming unit; a developer storage unit that stores a liquid developer including a toner and an aqueous medium; a developer supply member that supplies the liquid developer to a latent image holding member; and a transfer unit that transfers a toner image to a recording medium. The developer supply member has a surface formed of a liquid absorbent member and is disposed such that a part of the liquid absorbent member is immersed in the liquid developer stored in the liquid developer storage unit and that another part of the liquid absorbent member is in contact with and compressed by the latent image holding member. The water repellency of the surface of the latent image holding member is higher than the water repellency of the surface of the developer supply member.

16 Claims, 3 Drawing Sheets

IMAGE FORMING DEVICE AND PROCESS CARTRIDGE

CROSS-REFERENCE TO RELATED APPLICATIONS

This application is based on, and claims priority under 35 USC 119 from Japanese Patent Application No. 2008-083110 filed on Mar. 27, 2008.

BACKGROUND

1. Technical Field

The present invention relates to an image forming device and a process cartridge.

2. Related Art

A magnetic printing device that prints the required number of copies upon a single formation of a latent image is known. The magnetic printing device holds a magnetic latent image magnetically formed on a magnetic recording medium (magnetic latent image holding member); supplies a magnetic toner to the magnetic recording medium in a developing area to develop the magnetic latent image as a toner image; presses a recording medium, such as paper, against the magnetic recording medium in a transfer area to transfer the developed toner image to the recording medium; and conveys the recording medium after transfer to a fixing area for fixation to thereby complete printing.

SUMMARY

According to an aspect of the invention, there is provided an image forming device, including: a latent image holding member; a latent image forming unit that forms a latent image on the latent image holding member; a developer storage unit that stores a liquid developer containing a toner and an aqueous medium; a developer supply member that supplies the liquid developer to the latent image holding member to thereby develop the latent image as a toner image; and a transfer unit for transferring the toner image to a recording medium. In the image forming device, the developer supply member has a surface formed of a member having liquid absorbing properties and is disposed such that a part of the member having liquid absorbing properties is immersed in the liquid developer stored in the liquid developer storage unit and that another part of the liquid absorbent member is in contact with and compressed by the latent image holding member. Further, in the image forming device, the water repellency of the surface of the latent image holding member is higher than the water repellency of the surface of the developer supply member.

BRIEF DESCRIPTION OF THE DRAWINGS

Exemplary embodiments of the present invention will be described in detail based on the following figures, wherein.

DETAILED DESCRIPTION

Figure 1:
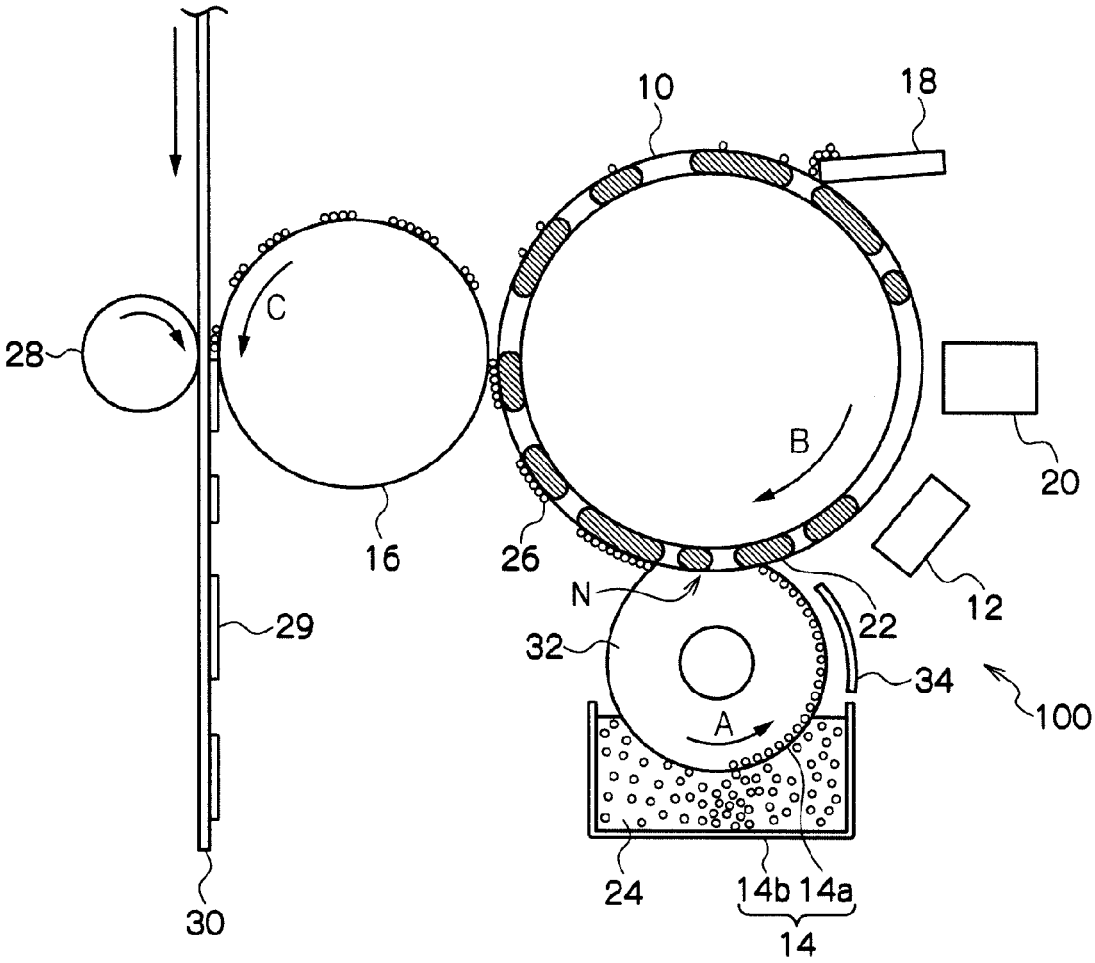
FIG. 1 is a schematic configuration diagram illustrating an example of the image forming device of the present invention.

Hereinafter, an exemplary embodiment will be described in detail. A process cartridge according to the present exemplary embodiment will also be described together with the following exemplary embodiments of an image forming device.

The image forming device of the present exemplary embodiment includes: a latent image holding member; a latent image forming unit that forms a latent image on the latent image holding member; a developer storage unit that stores a liquid developer containing a toner and an aqueous medium; a developer supply member that supplies the liquid developer to the latent image holding member to thereby develop the latent image as a toner image; and a transfer unit that transfers the toner image to a recording medium. In the image forming device, the developer supply member has a surface formed of a member having liquid absorbing properties (hereinafter simply referred to as a "liquid absorbent member") and is disposed such that a part of the liquid absorbent member is immersed in the liquid developer contained in the developer storage unit and that another part of the liquid absorbent member is in contact with and compressed by the latent image holding member. Further, the water repellency of the surface of the latent image holding member is higher than the water repellency of the surface of the developer supply member.

According to the present exemplary embodiment, a liquid developer in which a toner has been dispersed in an aqueous medium is used as a developer. The above-mentioned aqueous medium as used herein refers to a solvent containing 50 weight % or more of water. Further, "water" refers to refined water, such as distilled water, ion exchange water or ultrapure water.

In the present exemplary embodiment, the developer supply member, whose surface is formed of the liquid absorbent member, is disposed in such a manner as to be in contact with and compressed by the latent image holding member (hereinafter, an area where the developer supply member is in pressure-contact with the latent image holding member is referred to as a "compression area"). Thus, the liquid developer that has been absorbed by the liquid absorbent member at the liquid developer storage unit and is held by the liquid absorbent member of the surface of the developer supply member oozes out at the compression area to thereby develop a latent image on the surface of the latent image holding member.

Moreover, at a place where the liquid absorbent member of the surface of the developer supply member is released from compression, the solvent in the liquid developer and the toner adhering to a non-image area are collected as a result of the capillary phenomenon, and the residual solvent on the latent image holding member is thereby reduced.

Furthermore, an aqueous medium is used as a solvent in the liquid developer. Since water has a high surface tension due to hydrogen bonding, the solvent does not easily transfer to the latent image holding member even when the liquid developer contacts with the latent image holding member at the time of development if the latent image holding member has a higher water repellency than that of the developer supply member. The solvent which remains on the developer supply member side without transferring is collected as a result of the capillary phenomenon of the liquid absorbent member of the surface of the developer supply member and the residual solvent on the latent image holding member is thereby reduced.

An image formation process applied to the present exemplary embodiment refers to a process of forming a latent image on a latent image holding member, and forming a toner image by using the liquid developer. This process is not limited insofar as the above-described features of the present exemplary embodiment are imparted. For example, the image formation process may be applied to magnetic development processes and processes using, as a developer for printing, a toner or ink which has been dispersed in an aqueous solvent.

In the following description, among the development processes using the liquid developer of the present exemplary embodiment, an image forming device using a magnetic development process will be briefly described. Please note that details such as constituents of a liquid developer to be used will be described below.

FIG. 1 is a schematic configuration diagram illustrating an example of an image forming device of the present exemplary embodiment. The image forming device 100 includes a magnetic drum (a magnetic latent image holding member) 10, a magnetic head (a magnetic latent image forming unit) 12, a developing unit 14 equipped with a developer storage unit 14*b* and a developer supply member (a developing roller) 14*a*, an intermediate transfer member (a transfer unit) 16, a cleaner 18, a demagnetizer 20, and a transfer fixing roller (a transfer unit) 28. The magnetic drum 10 has a cylindrical shape, and, on the outer circumference of the magnetic drum 10, the magnetic head 12, the developing unit 14, the intermediate transfer member 16, the cleaner 18, and the demagnetizer 20 are consecutively provided.

Hereinafter, the operation of this image forming device 100 will be briefly described.

First, the magnetic head 12 is connected to, for example, an information device (not illustrated), and receives binarized image data which has been sent from the information device. The magnetic head 12 forms a magnetic latent image 22 in the magnetic drum 10 by emitting magnetic lines of force while scanning the outer circumferential surface of the magnetic drum 10. It should be noted that, in FIG. 1, the magnetic latent image 22 is indicated by a crosshatched part in the magnetic drum 10.

The developing unit 14 contains a developing roller (a developer supply member) 14*a* and a developer storage container (a developer storage unit) 14*b*. The developing roller 14*a* has a surface formed of a foam body 32 as a liquid absorbent member, and is provided in such a manner that a portion of the foam body 32 is immersed in a liquid developer 24 stored in the developer storage container 14*b*. Moreover, another portion of the foam body 32 is in contact with and compressed by the magnetic drum 10. It should be noted that the magnetic drum 10 and the developing roller 14*a* are rotated in the opposite directions to each other as indicated by the arrow B and the arrow A illustrated in FIG. 1. The developing roller 14*a* is provided vertically beneath (a downward direction in FIG. 1) the magnetic drum 10. At the downstream side (the downstream side indicated by the arrow A) of an area of the developing roller 14*a* in which the developing roller 14*a* is immersed in the liquid developer 24, a shielding member 34 is provided that suppresses the splashing of droplets which are scattered from the foam body 32 due to the rotation of the developing roller 14*a*.

The liquid developer 24 contains an aqueous medium and toner particles. The magnetic toner is formed of toner particles including a magnetic material. The details of the aqueous medium or the toner particles will be described below.

Figure 2:
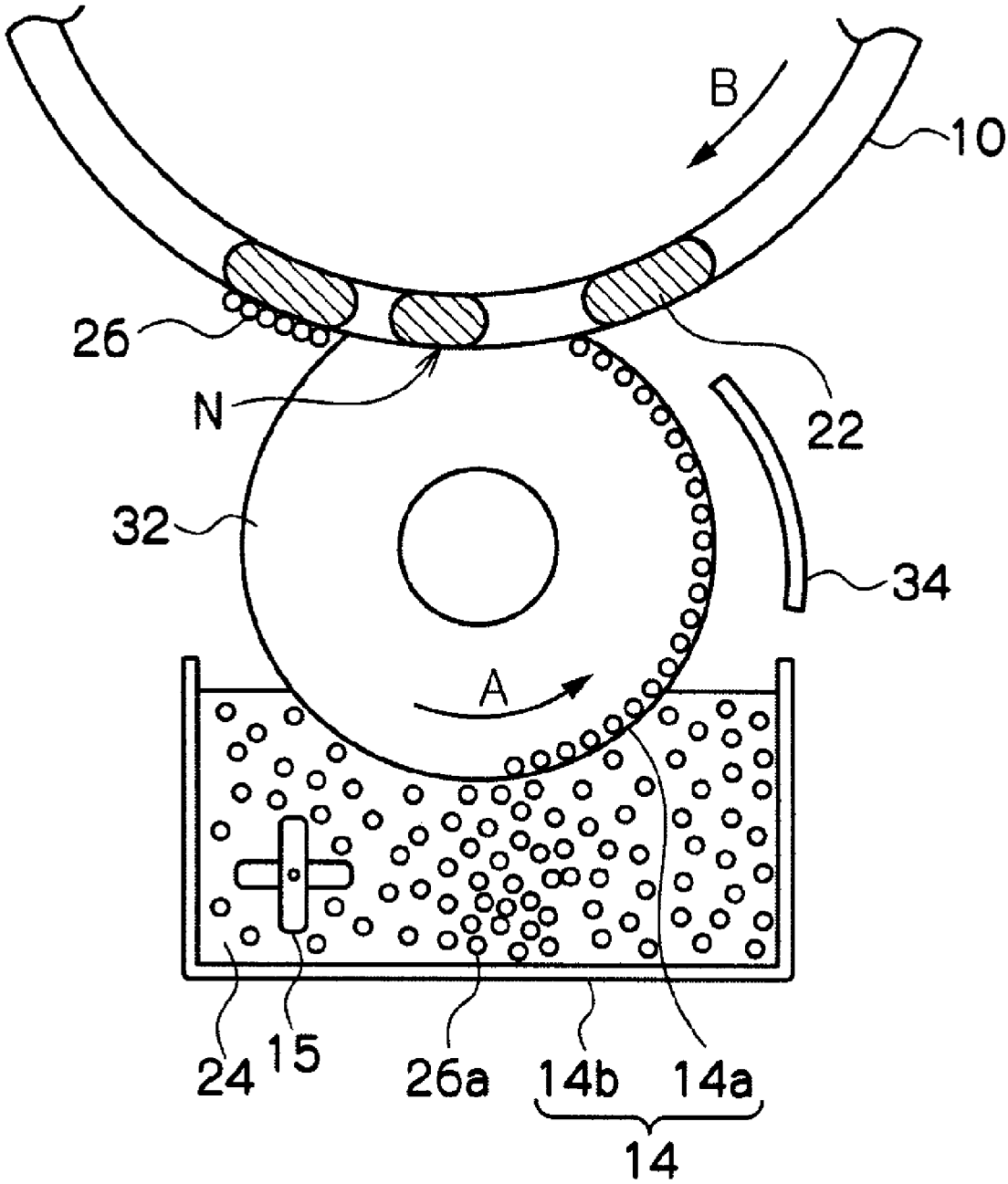
FIG. 2 is an enlarged schematic diagram illustrating a developing area in an example of the image forming device of the present invention.

The liquid developer 24 is stirred at a given rotational speed by a stirring member 15 provided in the developer storage container 14*b* (see FIG. 2).

The liquid developer 24 supplied to the foam body 32 of the surface of the developing roller 14*a* is conveyed to the magnetic drum 10, and is supplied to the magnetic latent image 22 at a position where the foam body 32 is compressed by the magnetic drum 10 (compression area N). Thus, the magnetic latent image 22 is developed to thereby form a toner image 26.

Moreover, at a location where the foam body 32 is released from compression, both the solvent in the liquid developer 24 and the toner adhered to a non-image area are collected.

The toner image 26 developed as described above is conveyed by the magnetic drum 10 rotating in the direction indicated by the arrow B of FIG. 1, and transferred to a sheet (a recording medium) 30. However, in the present exemplary embodiment, the toner image is transferred to the intermediate transfer member 16 temporarily before being transferred to the sheet 30 in order to enable simultaneous transfer and fixation of the toner image 26 to the recording medium 30.

Since the toner particles have almost no electrical charge, the transfer to the intermediate transfer member 16 may be conducted by shearing transfer (non-electric field transfer). Specifically, the magnetic drum 10 rotating in the direction indicated by the arrow B and the intermediate transfer member 16 rotating in the direction indicated by the arrow C contact with each other at a given contact area (the contact surface having a contact width in the direction of movement), at which the toner image 26 is shifted to the intermediate transfer member due to adsorption force, which is stronger than the magnetic force that the magnetic drum 10 exerts on the toner image 26. At this time, a peripheral speed difference between the magnetic drum 10 and the intermediate transfer member 16 may be provided.

Subsequently, the toner image conveyed in the direction indicated by the arrow C by the intermediate transfer member 16 is transferred to the sheet 30 at a position in contact with a transfer fixing roller 28, and simultaneously fixed thereto.

Specifically, the sheet 30 is sandwiched by the transfer fixing roller 28 and the intermediate transfer member 16, whereby the toner image on the intermediate transfer member 16 is closely contacted with the sheet 30. Thus, the toner image is transferred to the sheet 30, and simultaneously, the toner image is fixed to the sheet 30. The toner image may be fixed by merely applying pressure or by applying pressure and heating by providing a heating unit to the transfer fixing roller 28, depending on the properties of the toner.

On the other hand, in the magnetic drum 10 which has transferred the toner image 26 to the intermediate transfer member 16, a transfer residual toner is conveyed to a position in contact with a cleaner 18, and is collected by the cleaner 18. After cleaning, the magnetic drum 10 rotates to a demagnetization position while holding the magnetic latent image 22.

A demagnetizer 20 removes the magnetic latent image 22 formed on the magnetic drum 10. The magnetic drum 10 is returned, by the cleaner 18 and the demagnetizer 20, to a state before the image formation where there is no variation in the magnetization state of the magnetic layer. By repeating the above operation, images sent one after another from the information device are formed continuously in a short time. It should be noted that the magnetic head 12, the developing unit 14, the intermediate transfer member 16, the transfer fixing roller 28, the cleaner 18, and the demagnetizer 20, which are provided in the image forming device 100, are all operated in synchronism with the rotational speed of the magnetic drum 10.

Next, the respective components of the image forming device of the present exemplary embodiment will be described sequentially.

(Magnetic Latent Image Holding Member)

With respect to the structure of the magnetic drum (the magnetic latent image holding member), for example, a foundation layer, such as a layer of Ni or Ni—P, is formed on a drum made from a metal such as aluminum, in such a manner as to have a thickness of from about 1 μm to about 30 μm; a magnetic recording layer such as a layer of Co—Ni, Co—P, Co—Ni—P, Co—Zn—P, or Co—Ni—Zn—P, is formed thereon in such a manner as to have a thickness of from about 0.1 μm to about 10 μm; and a protective layer, such as a layer of Ni or Ni—P, is further formed thereon in such a manner as to have a thickness of from about 0.1 μm to about 5 μm. In order to form the foundation layer, detailed and uniform plating that is free from defects such as pinholes may be conducted. Other than plating, it is also possible to use a method such as spattering or deposition. Furthermore, the foundation layer and/or the protective layer may be nonmagnetic. The surface accuracy of the surface of each layer may be maintained by tape polishing or the like.

The thickness of the magnetic recording layer may be within the range of from 0.1 μm to 10 μm. With respect to the magnetic properties of the magnetic recording layer, the coercive force may be from 16000 A/m to 80000 A/m (from 200 oersteds to 1000 oersteds (Oe)) and the residual magnetic flux density may be from 100 mT to 200 mT (from 1000 gausses to 2000 gausses (G)).

The above description is directed to the structure of the magnetic drum 10 in the case of a horizontal magnetic recording system. In contrast, in the case of a vertical magnetic recording system, a recording layer such as a layer of Co—Ni—P may be provided on the nonmagnetic layer, or a soft magnetic layer with a high magnetic permeability may be provided under the recording layer. Thus, any structure may be acceptable without limitation. The shape of the magnetic latent image holding member is not limited to the drum-like shape in the present exemplary embodiment, and may be formed into a belt-like shape.

In the present exemplary embodiment, the water repellency of the surface of the magnetic drum 10 is set to be higher than a foam body 32 described below. The water repellency as used herein refers to the property of repelling water, and it is specifically determined by the contact angle with pure water.

The contact angle of pure water on the surface of the magnetic drum 10 is preferably 70° or more (or about 70° or more), and more preferably 100° or more.

It should be noted that the contact angle on the surface of the magnetic drum 10 is determined using a contact angle meter (CA-X, manufactured by Kyowa Interface Science Co., Ltd.) under the environment of a temperature of 25° C., a relative humidity of 50% RH, and when 15 seconds have passed after adding 3.1 μl of pure water dropwise to the surface of the magnetic drum. The measurement is performed at four points (both ends and central portions) in the circumferential direction, and the average of the four measurement values is used as the contact angle. Moreover, the contact angle on the foam body 32 (or a liquid absorbent member) described below is also measured by the above-described method.

In order to allow the surface of the magnetic drum 10 to have the above-mentioned preferable contact angle, the surface of the magnetic drum structured as described above may be subjected to surface coating.

Examples of the surface coating include fluorine lubrication plating and coating using a polymer containing a fluorine atom or a silicon atom. The fluorine lubrication plating refers to functional plating in which a fluororesin (polytetrafluoroethylene: PTFE) has been composited and co-deposited in electroless nickel plating. The PTFE particles are uniformly deposited in the formed coating, and thus the coating is imparted with both the properties of the electroless nickel plating and PTFE resin.

As the coating using the polymer containing a fluorine atom or a silicon atom, for example, a polymer having a fluorine-containing cyclic structure, a copolymer of fluoroolefin and vinyl ether or a photopolymerization type fluororesin composition and the like may be applied to the surface of the protective layer, or a fluorine atom-containing polymer may be sputtered onto the surface of the protective layer to thereby coat the entire surface with the polymer.

Among the above, fluorine lubrication plating is preferable. It should be noted that the above-mentioned fluorine lubrication plating and fluororesin coating may be performed to the surface on which the protective layer has been formed, or the layer which is formed by, for example, fluorine lubrication plating, may be used as the protective layer as is.

The thickness of the surface layer formed by surface coating is preferably from 0.1 μm to 5 μm, and more preferably from 0.3 μm to 3 μm.

(Magnetic Latent Image Forming Unit)

A magnetic latent image forming device (a magnetic latent image forming unit) is essentially formed from the magnetic recording head 12 and a drive circuit thereof. The magnetic recording head 12 is mainly classified into two types: a full line magnetic recording head and a multi-channel magnetic recording head. In the case of the full line magnetic recording head, it is not necessary to scan the magnetic recording head 12 but, in the case of the multi-channel magnetic recording head, it is necessary to scan the magnetic recording head 12 in relation to the magnetic drum 10. The scanning method is classified into serial scanning and helical scanning. In the case of the helical scanning, the recording rate increases as a result of changing the rotational speed of the magnetic drum 12 specially only in the latent image formation process.

In contrast, for example, in the case of the full line magnetic recording head, when the resolution is set to 600 dpi (number of dots per inch), a head of about 500 channels is required so as to cover the recording width in the width direction of A4 size paper. When such a head is arranged to form a full line, it is not necessary to scan the head, resulting in recording being able to be performed at an extremely high rate. In order to achieve the formation of a full line, the head cores need to be superposed; however, the track pitch decreases with an increase in the resolution. Therefore, as a coil to be inserted into the head core, a coil as thin as possible, such as a plate-shaped sheet coil, may be used.

By applying electric current to the coil of each channel of the magnetic recording head 12, magnetic flux leakage arises at the end of a magnetic pole. This magnetizes a magnetic recording medium to thereby form a magnetic latent image. The output from the magnetic recording head 12 is, for example, from two to three times the coercive force of the magnetic recording layer in the magnetic drum 10. The magnetic latent image formed here does not disappear unless removed by the demagnetizer 20, and has a function of providing a large number of copies by repeating each step of development, transferring, fixation, and cleaning.

(Developer Storage Unit, Developer Supply Unit)

FIG. 2 is an enlarged schematic diagram illustrating a developing area in FIG. 1.

The developing unit (developer supply unit) 14 is provided with the developer storage container **14*b* and the developing roller (developer supply member) 14*a* which supplies the liquid developer 24 stored in the developer storage container 14*b* to the magnetic drum 10 (for example, a process cartridge is constituted by the magnetic drum 10 and the developing unit 14**).

As illustrated in FIG. 2, the liquid developer 24 containing toner particles **26*a* and an aqueous medium is stored in the developer storage container 14*b*. Moreover, the developing roller 14*a* has a surface formed of the foam body 32. The foam body 32 is immersed in the liquid developer 24 in the developer storage container 14***b*, and as a result of the foam body 32 being impregnated with the liquid developer 24, the liquid developer 24 is held in the developing roller 14*a*. The foam body 32 of the surface of the developing-roller 14*a* is provided in such a manner that a part thereof is in contact with and compressed by the magnetic drum 10. The liquid developer 24 held in the foam body 32 oozes out at a compression area N, and thus a toner image is developed on the magnetic latent image 22 of the magnetic drum 10. Furthermore, at a location where the foam body 32 is released from compression, both the solvent in the liquid developer 24 and the toner adhered to the non-image area are collected. Similarly as in FIG. 1, the reference numeral 26 denotes a toner image and the reference character B denotes a direction of rotation of the magnetic drum 10.

It should be noted that the magnetic drum 10 and the developing roller 14*a* are rotated in the opposite directions to each other as indicated by the arrow B and the arrow A illustrated in FIG. 1. The developing roller 14*a* is provided vertically beneath (a downward direction in FIG. 1) the magnetic drum 10. At the downstream side (the downstream side indicated by the arrow A) of an area of the developing roller 14*a* in which the developing roller 14*a* is immersed in the liquid developer 24, a shielding member 34 is provided that suppresses the splashing of droplets which are scattered from the foam body 32 due to the rotation of the developing roller 14*a*.

Here, the foam body 32 will be described. The foam body 32 refers to a member which has fine pores and can absorb liquid by the capillary phenomenon.

Examples of the foam body 32 include a sponge and a nonwoven fabric.

The water retention rate of the foam body 32 used in the present example varies depending on the extent of compression of the foam body 32 described below, and is preferably larger than 900% (or about 900%), and more preferably 950% or more. By increasing the water retention rate to be larger than 900%, both the solvent and the toner adhered to the non-image area of the surface of the latent image holding member can be efficiently recovered.

It should be noted that the water retention rate is measured by the following method.

First, a dry foam body 32 processed into a size of 20 mm×20 mm×20 mm is prepared, and the weight is measured with, for example, an electronic balance. Next, pure water is supplied to the dry foam body 32, and the weight is measured when the absorption is in a state of saturation. Then, by subtracting the weight of the dry foam body 32 from the obtained weight, the weight of the pure water absorbed by the foam body 32 is determined. Finally, by dividing the weight of the pure water absorbed by the foam body 32 by the weight of the dry foam body 32, the water retention rate is determined. These measurements are performed three times, and then the average of the three measurement values is adopted as the final water retention rate. Moreover, the standard deviation of the water retention rate is also calculated, and is used as an evaluation item of the water retention rate.

The water retention rate described in the present specification is determined by the above-described method.

Moreover, the fine pore diameter of the foam body 32 is measured by the following method.

First, a flat cross section of the foam body 32 is exposed by using a grinder or the like while maintaining the shape of the fine pores. The cross section is subjected to magnified observation under, for example, an optical microscope, and then the diameters of 100 fine pores in the observation area are measured. The average of the diameters of the fine pores which are obtained by the measurement is used as the fine pore diameter of the foam body 32. It should be noted that the diameter of each fine pore is defined as the maximum length in one direction wherein the direction is determined before measuring the diameters of the 100 fine pores.

The fine pore diameters described in the present specification are measured by the above-described method.

Moreover, the hardness of the foam body 32 is measured by the following method.

The hardness of the foam body 32 having a thickness of 100 mm or more is measured using the Aska C hardness meter. The average of values obtained at three different points of the foam body 32 is adopted as the hardness of the foam body 32.

The hardness described in the present specification is measured by the above-described method.

The extent in which the foam body 32 is compressed (extent of compression) at the compression area N (the difference between the outer diameter of the foam body 32 in the non-compressed portion and the outer diameter of the foam body 32 in the most compressed portion) varies, depending on the water retention rate of the foam body 32 and the outside diameter of the developing roller 14*a*. When the outside diameter of the developing roller 14*a* is 25 mm for example, the extent of compression is preferably from 0.1 mm to 10 mm, more preferably from 0.5 mm to 8 mm, and particularly preferably from 1 mm to 5 mm.

Although the present exemplary embodiment is directed to an example in which the surface of the developing roller 14*a* is formed of the foam body 32, it should be noted that any liquid absorbent members can be used without limitation insofar as the members have liquid absorbing properties. Examples of liquid absorbent members include cloth members (specifically felt).

(Transfer Unit, Fixation Unit)

The toner image developed by the developing unit 14 is transferred to the sheet 30 by a transfer unit. As described above, in the present exemplary embodiment, the toner image is not directly transferred to the sheet from the magnetic drum 10, but a system is employed whereby the toner image is first transferred to the intermediate transfer member 16 temporarily, and then transferred and fixed to the sheet 30. First, the transfer to the intermediate transfer member 16 will be described.

The intermediate transfer member 16 contacts the magnetic drum 10, and the toner image is transferred. Examples of the transfer system generally include an electrostatic transfer system, a pressure transfer system, and an electrostatic pressure transfer system in which the electrostatic transfer system and the pressure transfer system are used in combination. However, as described above, since the toner particles do not have a charge in the present exemplary embodiment neither the electrostatic transfer system nor the electrostatic pressure transfer system is used. In contrast, according to a usual pressure transfer system, the toner image is adhered and transferred to the surface of the transfer medium while being plastically deformed by the pressure between the magnetic drum 10 and the transfer medium. The pressure transfer system may be used in combination with shearing transfer.

In the present exemplary embodiment, since the toner image 26 is shifted to the intermediate transfer member due to adsorption force, which is stronger than the magnetic force that the magnetic drum 10 exerts on the toner image 26 on the magnetic drum 10 as described above, adhesiveness may be provided to the intermediate transfer member 16 so as to enable transfer by adhesion. Therefore, a silicone rubber layer with low hardness, for example, may be provided on the surface of the intermediate transfer member 16.

Subsequently, the toner image 26 that has been transferred to the intermediate transfer member 16 is transferred to a sheet.

In FIG. 1, the transfer fixing roller 28 is disposed at a side of the intermediate transfer member 16 that is opposite to a side a which the magnetic drum 10 is disposed, such that the transfer fixing roller 28 forms a contact area with the intermediate transfer member 16. The sheet 30 is fed to the contact area between the intermediate transfer member 16 and the transfer fixing roller 28 in accordance with the timing of when the toner image 26 on the intermediate transfer member 16 is conveyed to the contact area. The transfer fixing roller 28 is formed of, for example, a stainless steel base, a silicone rubber layer, and a fluororubber layer. By applying pressure to and holding the sheet 30, which passes through the contact area, with the intermediate transfer member 16 and transfer fixing roller 28, the toner image on the intermediate transfer member 16 is transferred to the sheet 30.

The present exemplary embodiment is structured such that the toner image 26 is transferred to the sheet 30 from the intermediate transfer member 16 and simultaneously the toner image 26 is fixed to the sheet 30. Specifically, when the intermediate transfer member 16 is in the form of a roller as illustrated in FIG. 1, the intermediate transfer member 16 forms a roller pair with the transfer fixing roller 28. Therefore, the intermediate transfer member 16 and the transfer fixing roller 28 may be structured similarly as a fixing roller and a pressurizing roller, respectively, in a fixation device to thereby demonstrate a fixation function. More specifically, when the sheet 30 passes through the contact area, the toner image is transferred and simultaneously the toner image is pressed by the transfer fixing roller 28 against the intermediate transfer member 16. Thus, the toner particles forming the toner image are softened and are simultaneously permeated into fibers of the sheet 30.

Even in this state, the toner image can be fixed to the sheet 30 depending on the type of toner particles to be used. Further, when fixation is not sufficient, by heating with the transfer fixing roller 28 or the like, the toner image melts and the toner particles penetrate into fibers of the sheet 30 for fixation to thereby form a fixed image 29.

In the present exemplary embodiment, the fixation to the sheet 30 is performed simultaneously with the transfer to the sheet 30. However, the transfer process and the fixation process may be separately performed, and the fixation process may be performed after the transfer process. In this case, the transfer roller which transfers a toner image from the magnetic drum 10 has a function similar to that of the intermediate transfer member 16.

(Cleaner)

When the transfer efficiency of the toner image from the magnetic drum 10 to the intermediate transfer member 16 does not reach 100%, a portion of the toner image 26 remain on the magnetic drum 10 after transfer. A cleaner 18 removes the remaining toner image. Cleaner 18 is basically formed of a cleaning blade, such as rubber, and a container for the remaining magnetic toner.

It should be noted that when the transfer efficiency is nearly 100% and the residual toner does not pose a problem, it is not necessary to provide the cleaner 18.

(Demagnetization Unit)

When a new image is formed again, it is necessary to remove the remaining magnetic latent image before forming a new magnetic latent image by the magnetic recording head 12. The demagnetizer 20 is classified into two types: a permanent magnet type and an electromagnetic type. In the case of a permanent magnet type, it is structured so that magnetization is effected in the circumferential direction of the magnetic drum 10 to prevent local leakage of magnetic flux. Thus, the permanent magnet type does not require energy, such as electric power, and is inexpensive. However, when the magnetic latent image should not be removed, it is possible to weaken an erasing magnetic field by moving the demagnetizer 20 in relation to the magnetic drum 10 to thereby increase magnetic distance therebetween. In contrast, the electromagnetic type demagnetizer is formed of a yoke and a coil and needs to apply electric current. However, when the magnetic latent image does not need to be removed, an erasing field becomes zero by cutting the electric current. Thus, control is relatively freely performed.

In the present exemplary embodiment, both the permanent magnet type and the electromagnetic type demagnetizer can be used.

(Liquid Developer)

Next, the liquid developer 24 used in the image forming device 100 having the above-mentioned structure will be described.

The liquid developer 24 used in the present exemplary embodiment has a structure in which the magnetic toner **26*a* is dispersed in an aqueous medium. In general, a magnetic polymer particle containing magnetic powder in a polymer compound is used as the magnetic toner 26*a***. It should be noted that the magnetic polymer particle is a particle in which a magnetic powder is dispersed in the polymer.

—Polymer Compound—

A resin which has been conventionally used in magnetic recording devices is used as a polymer compound. Specific examples include: homopolymers of styrene and its substitution product, and copolymer resins thereof; copolymer resins of styrene and a (meth)acrylic ester; multicomponent copolymer resins of styrene, a (meth)acrylic ester and one or more other vinyl monomers; styrene copolymer resins of styrene and one or more other vinyl monomers; and substances in which a part of each resin mentioned above is crosslinked. Furthermore, examples include polymethyl methacrylate, polybutyl methacrylate, a polyvinyl acetate resin, a polyester resin, an epoxy resin, a polyamide resin, a polyolefin resin, a silicone resin, a polybutyral resin, a polyvinyl alcohol resin, a polyacrylic resin, a phenol resin, an aliphatic or alicyclic hydrocarbon resin, a petroleum resin, a styrene-vinyl acetate copolymer resin, an ethylene-vinyl acetate copolymer resin, and a wax resin, and mixtures thereof.

As described above, the magnetic polymer particles are dispersed in an aqueous medium as the magnetic toner **26*a***. However, there are cases when it is difficult to uniformly disperse magnetic polymer particles with the structure of a common polymer particle in an aqueous medium. This is because a polymer compound is hydrophobic and the surface of magnetic polymer particles has different properties from common polymer particles.

In the present exemplary embodiment, in consideration of the above-described viewpoints, a particular polymer compound obtained by controlling the monomer species and/or composition for forming a polymer is used as set forth below, whereby the magnetic polymer particle may be dispersible in an aqueous medium, and developability on the magnetic latent image holding member may be superior. Hereinafter, the structure of a polymer compound that may be used in the present exemplary embodiment will be described.

The polymer compound may be a polymer obtained by polymerization of ethylenically unsaturated monomers that include a hydroxyl group-containing monomer and a hydrophobic monomer, wherein the amount of hydroxyl groups in the polymer is from 0.1 mmol/g to 5.0 mmol/g.

The liquid developer 24 in the present exemplary embodiment has a composition in which magnetic toner particles (magnetic polymer particles) are dispersed in an aqueous medium as described above. Therefore, in order to obtain dispersibility into an aqueous medium as magnetic toner particles while maintaining magnetic force above a certain level, it is effective to allow a hydroxyl group to be present on the particle surfaces. To that end, a constituent component of the particle-forming polymer may have a hydroxyl group.

With respect to the polymer of an ethylenically unsaturated monomer preferably used as the polymer compound in the present exemplary embodiment, the amount of hydroxyl groups of the polymer may be adjusted to the optimal range by selecting an appropriate copolymerization ratio of the hydroxyl group-containing hydrophilic monomer and the hydrophobic monomer, in consideration of dispersibility in the aqueous medium and stability of the polymer particle, as well as the content of magnetic powder contained in the polymer particle.

Since the amount of the hydroxyl groups varies depending on the content of magnetic powder, the amount of the hydroxyl groups is defined as an amount of hydroxyl groups of a polymer component excluding the magnetic powder. The amount of the hydroxyl groups is preferably from 0.1 mmol/g to 5.0 mmol/g, more preferably from 0.2 mmol/g to 4.0 mmol/g, and still more preferably from 0.3 mmol/g to 3.0 mmol/g.

It should be noted that the amount of hydroxyl groups is obtained by a general titration method. For example, a fixed amount of reagent, such as a pyridine solution of acetic anhydride, is added to the polymer and then heated. Water is added for hydrolysis, and then the resultant is divided into particles and a supernatant with a centrifugal separator. Then, the supernatant is titrated with, for example, an ethanolic potassium hydroxide solution using an indicator such as phenolphthalein, whereby the amount of hydroxyl groups is determined.

The ethylenically unsaturated monomer refers to a monomer having an ethylenically unsaturated group, such as a vinyl group. The following hydrophilic monomers and hydrophobic monomers are included in the scope of the ethylenically unsaturated monomer in the present exemplary embodiment.

Examples of the hydroxyl group-containing hydrophilic monomer include 2-hydroxyethyl(meth)acrylate, 2-hydroxypropyl(meth)acrylate, 3-hydroxypropyl(meth)acrylate, glycerol di(meth)acrylate, 1,6-bis(3-acryloxy-2-hydroxypropyl)-hexylether, pentaerythritol tri(meth)acrylate, tris-(2-hydroxyethyl)isocyanurate(meth)acrylate, and polyethylene glycol(meth)acrylate.

The (meth)acrylate as used herein refers to an expression indicating acrylate or methacrylate, and the same applies to the following description.

Among the above, it is preferable to use at least one selected from 2-hydroxyethyl(meth)acrylate and polyethylene glycol(meth)acrylate.

The magnetic polymer particle of the present exemplary embodiment may have a carboxyl group in a polymer in addition to a hydroxyl group. In this case, a monomer having a carboxyl group may be additionally included as the ethylenically unsaturated monomer.

Examples of the monomer having a carboxyl group used in the present exemplary embodiment include acrylic acid, methacrylic acid, methacryloyloxyethyl monophthalate, methacryloyloxyethyl monohexahydrophthalate, methacryloyloxyethyl monomaleate, and methacryloyloxyethyl monosuccinate.

Among the above, it is preferable to use methacryloyloxyethyl monophthalate from the point of view of control of the copolymerization ratio with the hydrophobic monomer described below, dispersion of the magnetic powder in a polymer particle, controllability of a polymerization reaction and the like.

Examples of the hydrophobic ethylenically unsaturated monomer include aromatic vinyl monomers, such as styrene and α-methyl styrene; alkyl(meth)acrylate esters having an alkyl group or an aralkyl group having 1 to 18 carbon atoms (preferably 2 to 16) (for example, methyl(meth)acrylate, ethyl(meth)acrylate, propyl(meth)acrylate, butyl(meth)acrylate, cyclohexyl(meth)acrylate, 2-ethylhexyl(meth)acrylate, lauryl(meth)acrylate, and benzyl(meth)acrylate); alkoxyalkyl (meth)acrylate esters having an alkylene group having 1 to 12 carbon atoms (preferably 2 to 10) (for example, methoxymethyl(meth)acrylate, methoxyethyl(meth)acrylate, ethoxymethyl(meth)acrylate, ethoxyethyl(meth)acrylate, ethoxybutyl (meth)acrylate, n-butoxymethyl(meth)acrylate, and n-butoxyethyl(meth)acrylate); amino group-containing (meth)acrylic esters (for example, diethylaminoethyl(meth) acrylate and dipropylaminoethyl(meth)acrylate); acrylonitrile, ethylene, vinyl chloride, and vinyl acetate.

Among the above, styrene, methyl(meth)acrylate, butyl (meth)acrylate, 2-ethylhexyl(meth)acrylate, lauryl(meth) acrylate, ethoxybutyl(meth)acrylate, benzyl(meth)acrylate, and diethylaminoethyl(meth)acrylate are preferable, and styrene, methyl(meth)acrylate, and butyl(meth)acrylate are particularly preferable.

The content of the hydrophobic monomer capable of being copolymerized with the hydrophilic monomer is preferably from 1 weight % to 99 weight %, and more preferably from 5 weight % to 95 weight % based on the total monomer components. In particular, when a monomer having a carboxyl group such as methacryloxyethyl monophthalate is used as an ethylenically unsaturated monomer in addition to the hydroxyl group-containing monomer, the content of the hydrophobic monomers is preferably from 20 weight % to 99 weight %, and more preferably from 50 weight % to 90 weight %, based on the total monomer components.

A crosslinking agent may be mixed as another monomer, if required, in a reactive mixture (a mixture containing, for example, the ethylenically unsaturated monomer) to be dispersed in an aqueous medium. By adding a crosslinking agent to a monomer mixed solution, aggregation during polymerization is suppressed and dispersion stability is ensured.

Known crosslinking agents may be selected as a crosslinking agent to be used. Preferable examples include divinylbenzene, ethylene grycerol di(meth)acrylate, diethylene grycerol di(meth)acrylate, methylene bis(meth)acrylamide, glycidyl (meth)acrylate, and 2-([1'-methylpropylideneamino]carboxyamino)ethyl methacrylate. Among the above, divinylbenzene, ethylene grycerol di(meth)acrylate, and diethylene grycerol di(meth)acrylate are more preferable, and divinylbenzene is particularly preferable.

Furthermore, from the point of view of improvement in fixation properties, the polymer compound in the present exemplary embodiment may contain a non-crosslinking resin. As the non-crosslinking resin, any polymers are acceptable without limitation insofar as the polymers fix particles to a target fixation medium such as paper or a film, by external energies such as heat, ultraviolet rays, or electron beams, solvent vapor, solvent volatilization from a polymer, or the like.

Specific examples include homopolymers or copolymers of: styrenes, such as styrene and chlorostyrene; monoolefins such as ethylene, propylene, butylene, and isoprene; vinyl esters, such as vinyl acetate, vinyl propionate, vinyl benzoate, and vinyl acetate; α-methylene aliphatic-monocarboxylic-acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinyl methyl ether, vinyl ethyl ether, and vinyl butyl ether; vinyl ketones such as vinyl methyl ketone, vinyl hexyl ketone, and vinyl isopropenyl ketone.

—Magnetic Powder—

As magnetic powder, magnetite, ferrite and the like, which are represented by the general formula $MO.Fe_2O_3$ or $M.Fe_2O_4$ which shows magnetism, may be used. Here, M is a divalent or monovalent metal ion (Mn, Fe, Ni, Co, Cu, Mg, Zn, Cd, Li or the like), and a single metal or plural metals may be used as M. Examples of the magnetic substance include iron oxides such as magnetite, γ ferric oxide, Mn—Zn ferrite, Ni—Zn ferrite, Mn—Mg ferrite, Li ferrite, and Cu—Zn ferrite. Magnetite is more preferably used.

As another metal oxide, a non-magnetic metal oxide in which one or multiple metals selected from Mg, Al, Si, Ca, Sc, Ti, V, Cr, Mn, Fe, Co, Ni, Cu, Zn, Sr, Y, Zr, Nb, Mo, Cd, Sn, Ba, Pb, and the like, may be used in combination with the above-mentioned metal oxide showing magnetism. For example, the non-magnetic metal oxide may be $Al_2O_3$, $SiO_2$, CaO, $TiO_2$, $V_2O_5$, $CrO_2$, $MnO_2$, $Fe_2O_3$, CoO, NiO, CuO, ZnO, SrO, $Y_2O_3$, $ZrO_2$ or the like.

The average primary particle diameter of the magnetic powder before hydrophobizing treatment described below may be from 0.02 μm to 2.0 μm.

The surface of the magnetic powder may be subjected to hydrophobizing treatment. There is no limitation on the hydrophobizing treatment method, and the hydrophobizing treatment is carried out by coating the surface of the magnetic powder with a hydrophobizing agent such as various coupling agents, silicone oil, or a resin. Among the above, it is preferable to coat the surface with a coupling agent.

The content of the magnetic powder may be determined in accordance with a required magnetism. In the present exemplary embodiment, the content of the magnetic powder is preferably adjusted to from 2 weight % to 50 weight %, and more preferably from 4 weight % to 30 weight %, with respect to the total amount of the constituents of the magnetic polymer particles.

—Other Components—

The magnetic polymer particle of the present exemplary embodiment may contain one or more substances selected from a dye, an organic pigment, carbon black, titanium oxide or the like for the purpose of coloring a polymer. In such a case, each additive mentioned above may be directly mixed in a mixture containing the monomer in which a magnetic powder has been dispersed. For example, especially when a pigment such as an organic pigment, carbon black, or titanium oxide is mixed, the pigment may be first mixed and dispersed in the non-crosslinking resin by known methods, such as a roll mill, a kneader, or an extruder, and then the resultant may be mixed in the mixture containing the polymerizable monomer.

Regarding a method for producing the magnetic polymer particle containing the monomers mentioned above and the like, for example, the ethylenically unsaturated monomers, a polymerization initiator, and other required components are first mixed to thereby produce a mixed-solution containing the monomers and the like. The mixing method is not particularly limited.

Known methods may be applied to the dispersion of the magnetic powder in the above-mentioned mixed solution. More specifically, for example, a disperser such as a ball mill, a sand mill, an attritor, or a roll mill may be used. When a monomer component is separately polymerized beforehand, and a magnetic powder is dispersed in the obtained polymer, a kneading machine such as a roll mill, a kneader, a Banbury mixer or an extruder may be used.

In order to obtain a magnetic polymer particle that may be used in the present exemplary embodiment, known methods may be utilized. For example, a suspension-polymerization method, an emulsion polymerization method, a dispersion polymerization method, a seed polymerization method or the like may be used. Furthermore, suspension polymerization may be performed using the emulsification method known as a membrane emulsification method.

The number average particle diameter of the magnetic polymer particle obtained thereby is preferably from 0.1 μm to 20 μm, and more preferably from 1.0 μm to 8.0 μm.

When the polymer compound has a carboxyl group, the amount of carboxyl groups is preferably from 0.005 mmol/g to 0.5 mmol/g. The amount of carboxyl groups is more preferably from 0.008 mmol/g to 0.3 mmol/g, and even more preferably from 0.01 mmol/g to 0.1 mmol/g.

The amount of carboxyl groups may be determined by a general titration method. For example, the amount of carboxyl groups can be determined by adding a reagent such as an ethanolic solution of potassium hydroxide to the polymer compound for neutralization; separating the resultant into particles and a supernatant with a centrifugal separator; and titrating the supernatant containing an excessive amount of potassium hydroxide with an isopropanol hydrochloric acid solution or the like using an automatic titrator.

The liquid developer in the present exemplary embodiment is a particle dispersion in which the magnetic polymer particles have been dispersed in an aqueous medium such as water.

Water or a mixed solvent obtained by adding a water-soluble organic solvent such as methanol or ethanol to water may be used as the aqueous medium. Among the above, water by itself is preferable. In the case of adding a water-soluble organic solvent, the addition amount thereof is, depending on the properties of the monomer to be suspended, preferably 30 weight % or lower, and more preferably 10 weight % or lower, with respect to the total solvents.

Various supplementary materials which are used in a commonplace water-based particle dispersion can be used additionally in production of the liquid developer. Examples thereof include a dispersant, an emulsifier, a surfactant, a stabilizing agent, a wetting agent, a thickener, a foaming agent, a defoaming agent, a coagulant, a gelling agent, an anti-settling agent, an electrification control agent, an anti-static agent, an anti-aging agent, a softener, a plasticizer, a filler, a colorant, an oderant, an antitack agent, and a mold release agent.

Specifically, any known surfactants such as anionic surfactants, nonionic surfactants, or cationic surfactants are usable as the above-mentioned surfactant. Moreover, examples thereof include silicone surfactants such as a polysiloxane oxyethylene adduct; fluorosurfactants such as perfluoroalkyl carboxylate, perfluoroalkyl sulfonate, and oxyethylene perfluoro alkyl ether; and biosurfactants such as spiculisporic acid, rhamnolipid, and lysolecithin.

Insofar as the polymer has a hydrophilic component part and a hydrophobic component part, any polymers may be effectively used as the dispersant. Examples thereof include a styrene-styrene sulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an alkyl acrylate-acrylic acid copolymer, a methacrylic acid alkyl ester-methacrylic acid copolymer, a styrene-alkyl methacrylate-methacrylic acid copolymer, a styrene-alkyl acrylate-acrylic acid copolymer, a styrene-phenyl methacrylate-methacrylic acid copolymer, and a styrene-cyclohexyl methacrylate-methacrylic acid copolymer. These copolymers may have any structure such as a random copolymer, a block copolymer or a graft copolymer.

Moreover, in the present exemplary embodiment, a water-soluble organic solvent may be used for the purpose of controlling evaporativity or interfacial properties. Examples of the water-soluble organic solvent include an organic solvent which does not divide into two phases when added to water, such as monohydric alcohols, polyhydric alcohols, nitrogen-containing solvents, sulfur-containing solvents, and derivatives thereof.

Furthermore, for the purpose of adjusting the electroconductivity, pH and the like, one or more substances selected from the following may be added to the aqueous medium: alkaline metal compounds such as potassium hydroxide, sodium hydroxide, and lithium hydroxide; nitrogen-containing compounds such as ammonium hydroxide, triethanolamine, diethanolamine, ethanolamine, and 2-amino-2-methyl-1-propanol; alkaline earth metal compounds such as calcium hydroxide; acids such as sulfuric acid, hydrochloric acid, and nitric acid; and salts of a strong acid and a weak alkali such as ammonium sulfate.

In addition, for the purpose of mildew-proofing, antiseptic-ising, rust proofing and the like, benzoic acid, dichlorophen, hexachlorophene, sorbic acid and the like, may be added as required. Moreover, an antioxidant, a viscosity controlling agent, a conducting agent, a UV absorber, a chelating agent and the like may also be added as necessary.

In the present exemplary embodiment, the dispersion particle diameter of the magnetic polymer particle in the liquid developer is preferably from 0.1 μm to 20 μm, and more preferably from 1 μm to 8 μm, in terms of the average particle diameter. It should be noted that the dispersion average particle diameter of the magnetic polymer particle is a volume average particle diameter determined with the Multisizer 3 COULTER COUNTER (product of BECKMAN COULTER).

The production of the liquid developer may be performed by the following procedure, but is not limited thereto.

First, a dispersion medium containing water as a main solvent and the optional additives mentioned above is prepared using a magnetic stirrer or the like, and then the magnetic polymer particles are dispersed therein. Known methods are applicable to the dispersion. More specifically, a disperser such as a ball mill, a sand mill, an attritor, or a roll mill may be used. Moreover, examples of the method include a method in which dispersion is conducted by rotating a special stirring blade at a high speed (e.g., a mixer); a method in which dispersion is conducted utilizing a shear force generated by a rotor and a stator, which is known as a homogenizer; and a method in which dispersion is conducted utilizing ultrasonic waves.

Then, the liquid developer 24 as a recording liquid for image formation is obtained by the following procedure:

confirming that the magnetic polymer particles are independently dispersed in the liquid by observing a separated dispersion liquid under a microscope;

thereafter adding an additive such as an antiseptic agent, and confirming that the additive is dissolved; and then filtering the obtained dispersion liquid, using, for example, a membrane filter having a pore diameter of 100 μm to remove waste and coarse particles.

The viscosity of the liquid developer 24 in the present exemplary embodiment is, depending on an image forming system to be used, preferably from 1 mPa·s to 500 mPa·s.

EXAMPLES

In order to confirm the actions of the above-mentioned exemplary embodiment, the following tests are performed. In the following description, unless otherwise specified, "part" and "%" mean "part by weight" and "weight % respectively.

Test Example 1

(Production of Magnetic Polymer Particle)

400 parts of styrene acrylic-resin (S-LEC P-SE-0020, manufactured by Sekisui Chemical Co., Ltd.) are added to 600 parts of magnetic powder MTS-010 (manufactured by Toda Kogyo Corp.), and kneaded with a pressurizing kneader to thereby obtain magnetic powder whose surface is coated with a resin (magnetic powder content: 60%).

17 parts of hydroxyethyl methacrylate (manuractured by Wako Pure Chemical Ind., Ltd.), 57 parts of styrene monomer (manufactured by Wako Pure Chemical Ind., Ltd.), and 1 part of divinylbenzene (manufactured by Wako Pure Chemical Ind., Ltd.) are mixed. Thereafter, 40 parts of the surface-treated magnetic powder is added to the mixture, and the mixture is dispersed in a ball mill for 48 hours. 5 parts of azobisisobutyronitril (manufactured by Wako Pure Chemical Ind., Ltd.) as a polymerization initiator is added to 90 parts of the magnetic powder dispersion liquid to thereby produce a mixture containing a monomer and magnetic powder.

30 parts of calcium carbonate (LUMINUS, manufactured by Maruo Calcium Co., Ltd.) and 3.5 parts of carboxymethylcelluloses (CELLOGEN, manufactured by Dai-Ichi Kogyo Seiyaku Co., Ltd.) as dispersion stabilizers are added to an aqueous solution in which 28 parts of sodium chloride (manufactured by Wako Pure Chemical Ind. Ltd.) has been dissolved in 160 parts of ion exchange water. The resultant is dispersed in a ball mill for 24 hours to form a dispersion medium.

The mixture containing a monomer and magnetic powder produced above is put in 200 parts of the dispersion medium, and emulsified for 3 minutes at 8000 rpm with an emulsifier (HIGH-FLEX HOMOGENIZER, manufactured by SMT Co., Ltd.) to form a suspension. The number average particle diameter of the suspended particles at this time is 2.5 μm.

Separately, nitrogen is introduced in a separable flask, equipped with a stirrer, a thermometer, a cooling tube, and a nitrogen introduction tube, through the nitrogen introduction tube to convert the atmosphere within the flask to a nitrogen atmosphere. The above-obtained suspension is put therein, and reacted at 65° C. for 3 hours. The resultant is further heated at 70° C. for 10 hours, and then cooled. The reaction mixture becomes a dispersion liquid and no aggregate is visually observed during the polymerization.

A 10% aqueous hydrochloric acid solution is added to the reaction solution to decompose calcium carbonate, and solid liquid separation is performed by centrifugal separation. The obtained particles are washed with 1 L of ion exchange water, and then ultrasonic dispersion and centrifugal separation are repeated 3 times for 30 minutes in 500 ml of ethanol to thereby obtain magnetic polymer particles.

The magnetic polymer particles are dried in a 60° C. oven, and are made to pass through a mesh having a pore diameter of 5 μm to separate coarse particles. Then, the number average particle diameter is measured to be 2.7 μm.

The magnetic powder content in the particle is calculated by thermogravimetric analysis (TGA) from the amount of weight loss by heat treatment to be 15%.

The amount of hydroxyl groups of the magnetic polymer particle is 0.6 mmol/g. The measurement of the amount of hydroxyl groups is performed as follows.

First, the polymer particles are weighed, and placed in a test tube with a cap. A fixed amount of a pyridine (manufactured by Wako Pure Chemical Ind. Ltd.) solution of acetic anhydride (manufactured by Wako Pure Chemical Ind. Ltd.) prepared beforehand is added, and heated at 95° C. for 24 hours. Furthermore, distilled water is added for hydrolyzing the acetic anhydride in the test tube. Then, the resultant is subjected to centrifugal separation at 3000 rpm for 5 minutes to divide the resultant into particles and a supernatant. Further, a polymer is repeatedly subjected to ultrasonic dispersion and centrifugal separation with ethanol (manufactured by Wako Pure Chemical Ind. Ltd.) for washing. The supernatant and a washing liquid are collected in a conical beaker, and then titrated with a 0.1 M ethanolic potassium hydroxide solution (manufactured by Wako Pure Chemical Ind. Ltd.) using phenolphthalein (manufactured by Wako Pure Chemical Ind. Ltd.) as an indicator.

A blank test in which a polymer is not used is also conducted, and then the amount (mmol/g) of hydroxyl groups is calculated from the difference according to Equation (1) below.

$$\text{Amount of hydroxyl groups} = ((B-C)\times 0.1\times f)/(w-(w\times D/100)) \quad \text{Equation (1):}$$

In Equation (1) above, B represents the amount of the 0.1 M ethanolic potassium hydroxide solution added dropwise in the blank test (ml); C represents the amount of the 0.1 M ethanolic potassium hydroxide solution added dropwise for titrating the sample (ml); f represents a factor for the potassium hydroxide solution; w represents the weight (g) of particles; and D represents the content (%) of the magnetic powder in the particles.

(Production of a Liquid Developer)

5 parts of polyvinyl alcohol (PVA, Kuraray POVAL 217, manufactured by Kuraray Co., Ltd.; polymerization degree: 1700, saponification degree: 88 mol %) is added to 95 parts of a cooled ion exchange water. The mixture is dispersed by stirring with a magnetic stirrer, and further stirred for 3 hours for dissolution while heating at 70° C. in a water bath to thereby prepare an aqueous PVA solution (5% solution).

Magnetic polymer particle: 5 parts

Aqueous PVA solution: 10 parts

Polyoxyethylene (20) cetyl ether (manufactured by Wako Pure Chemical Ind. Ltd.): 0.5 parts Ion exchange water: 84.5 parts The above-mentioned respective components are mixed and dispersed in a ball mill for 3 hours to thereby prepare a liquid developer in which the magnetic polymer particles serve as a magnetic toner. 0.1 ml of the liquid developer is taken and dispersed in 100 ml of measurement liquid, ISOTON (manufactured by BECKMAN COULTER). Then, the volume average particle diameter (average diameter of dispersed particles) is determined with the Multisizer 3 COULTER COUNTER (product of BECKMAN COULTER) to be 3.0 μm.

(Image Formation)

An image forming device 100 having the structure illustrated in FIG. 1 is prepared, and the liquid developer is used as a developer.

As a magnetic drum 10, Ni—P is plated, on an aluminum drum, as a foundation layer in such a manner as to have a film thickness of 15 μm and Co—Ni—P is plated thereon as a magnetic recording layer in such a manner as to have a film thickness of 0.8 μm. Further, on the surface thereof, fluorine lubrication plating is performed using Ni—P-PTFE particles to form a protective layer having a thickness of 1.5 μm. The coercive force of the magnetic recording layer is 400 Oe, and the residual flux density is 7000 G.

The contact angle of the pure water on the surface of the magnetic drum 10 at 25° C. and at 50% RH is 110°.

A full line type magnetic head which has four channels capable of forming pixels equivalent to 600 dpi (number of dots per inch) and which is composed of Mn—Zn ferrite is prepared as a magnetic head 12.

A roller which is formed by "Tradename: Belleater, manufactured by AION Co., Ltd." and whose surface is formed of a foam body 32 is used as a developing roller **14*a*. With respect to the foam body 32**, the water retention rate is 1000%, the fine pore diameter is 180 μm, the hardness is 2, and the contact angle of pure water is 0.1°.

A stirring blade that stirs the liquid developer in the container **14*b* is provided in a developer storage container 14*b*, and the liquid developer is put in the developer storage container 14*b*. The developing roller 14*a* is disposed in such a manner that a portion thereof is immersed in the liquid developer 24 as illustrated in FIG. 1, and is disposed to form a compression area in which the foam body 32 of the surface of the developing roller 14*a* is in pressure-contact with the magnetic drum 10. The extent of compression of the foam body 32** is 1 mm.

An aluminum intermediate transfer drum which has a 7.5 mm thick silicone rubber layer on the surface and rotates at the same peripheral speed as that of the magnetic drum 10 is used as the intermediate transfer member 16. An elastic roll in which the outer circumference of a stainless steel core material is covered with a silicone rubber layer and a fluororubber layer in the stated order is used as the transfer fixing roller 28. Furthermore, the elastic roll is structured so that the surface temperature is heated with a heating unit to 170° C.

Printing conditions are set as follows with the image forming device 100 structured as above.

Magnetic drum linear velocity: 100 mm/sec

Developing-roller peripheral speed: 100 mm/sec

Transfer conditions (intermediate transfer): Pressure applied to the magnetic drum of the intermediate transfer member set to 0.147 MPa (1.5 kgf/cm$^2$)

Transfer fixation conditions: Pressure of the transfer fixing roller applied to the intermediate transfer member set to 0.245 MPa (2.5 kgf/cm$^2$)

Under the above-described conditions, a magnetic latent image (equivalent to a halftone) having a striped pattern of 30 μm/stripe is formed on the magnetic drum 10 by the magnetic recording head 12. Then, the liquid developer is brought into contact therewith by the developing roller for development.

To a portion in which the toner image 26 is not formed on the magnetic drum 10 after the development, almost none of the water of the liquid developer 24 adheres. As a result, no liquid adheres to the intermediate transfer drum 16 or the sheet 30 after the fixation.

Figure 3:
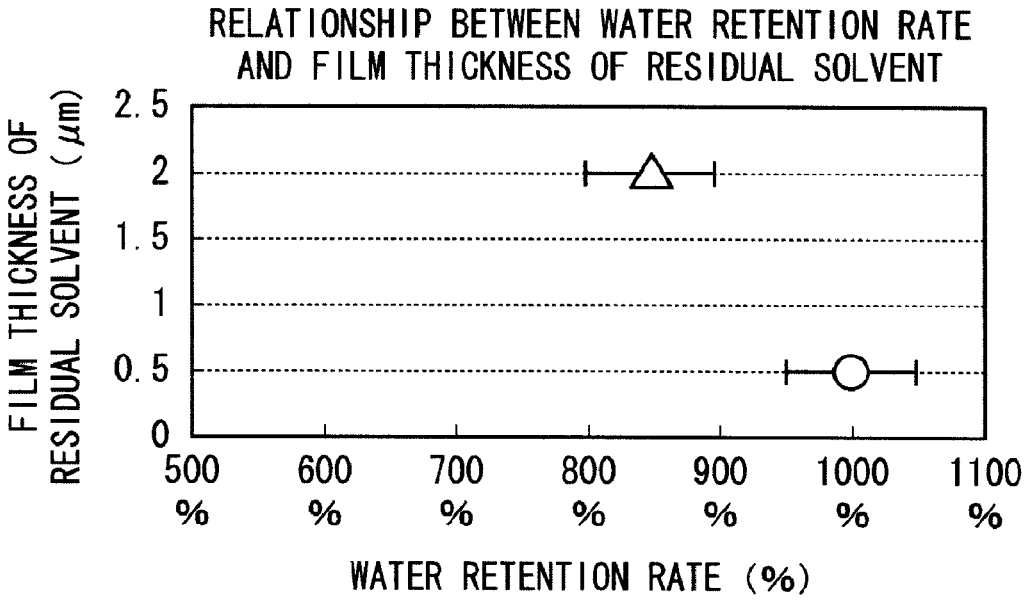
FIG. 3 is a graph illustrating the relationship between water retention rate and the film thickness of a residual solvent in Test Examples 1 and 2.

For evaluation purposes, the amount of the residual solvent (film thickness) on the surface of the magnetic drum 10 after the development is measured by the following method. The results are shown in FIG. 3.

At three points (both ends in the axial direction and the central portion) on the magnetic drum 10, the film thickness of moisture adhering to a portion in which the toner images 26 are not formed is measured using a laser displacement gauge (Trade name: LK-G30, manufactured by KEYENCE CORP.). The average thereof is defined as the amount of the residual solvent.

Test Example 2

Image formation is performed and evaluated in the same manner as in Test Example 1, except changing the foam body 32 used in Test Example 1 to a foam body having a water retention rate, a fine pore diameter, and a hardness as shown in Table 1.

The foam body used in Test Example 2 is SAQ (trade name), (contact angle of pure water: 0.1°) manufactured by INOAC CORPORATION.

TABLE 1

| | Foam Body | | | |
|---|---|---|---|---|
| | Water retention rate | Fine pore diameter | Hardness | Extent of compression |
| | Unit | | | |
| | % | μm | | mm |
| Test Example 1 | 1000 | 180 | 2 | 1 |
| Test Example 2 | 850 | 700 | 5 | 1 |

FIG. 3 illustrates the relationship between the water retention rate and the film thickness of residual solvent in Test Examples 1 and 2. It should be noted that "○" plotted in FIG. 3 represents the average water retention rate in Test Example 1; "Δ" represents the average water retention rate in Test Example 2; and that the ranges of the lines extending from "○" and from "Δ" show the standard deviations.

In Test Example 1 in which the amount of the residual solvent is 0.5 μm, the occurrence of poor transfer of a developed image to the intermediate transfer member is more effectively suppressed, and the deterioration in the image quality is favorably prevented. As shown in Test Example 2, the average water retention rate is 850% and the amount of residual solvent is 2 μm. However, considering the standard deviation, the deterioration in the image quality is more optimally suppressed when the average water retention rate is greater than 900%. Thus, the water retention rate is more preferably higher than 900%, and particularly preferably 950% or higher.

What is claimed is:

1. An image forming device, comprising:

a magnetic latent image holding member;

a magnetic latent image forming unit that forms a magnetic latent image on the magnetic latent image holding member;

a developer storage unit that stores a liquid developer including a toner and an aqueous medium;

a developer supply member that supplies the liquid developer to the magnetic latent image holding member to thereby develop the magnetic latent image as a magnetic toner image, the developer supply member having a surface formed of a liquid absorbent member and being disposed such that a part of the liquid absorbent member is immersed in the liquid developer stored in the liquid developer storage unit and that another part of the liquid absorbent member is in contact with and compressed by the magnetic latent image holding member; and a transfer unit that transfers the magnetic toner image to a recording medium, the water repellency of the surface of the magnetic latent image holding member being higher than the water repellency of the surface of the developer supply member.

2. The image forming device according to claim 1, wherein the water retention rate of the liquid absorbent member is higher than about 900%.

3. The image forming device according to claim 2, wherein the liquid absorbent member is a foam body, a sponge, or a nonwoven fabric.

4. The image forming device according to claim 1, wherein the surface of the magnetic latent image holding member is subjected to surface coating treatment.

5. The image forming device according to claim 1, wherein the contact angle of pure water on the surface of the magnetic latent image holding member is about 70° or more.

6. The image forming device according to claim 1, wherein the liquid absorbent member is a foam body, a sponge, or a nonwoven fabric; and the contact angle of pure water on the surface of the latent image holding member is about 70° or more.

7. The image forming device according to claim 1, further comprising a shielding member, wherein the developer supply member rotates; and the shielding member shields against a droplet scattered from the liquid absorbent member due to rotation of the developer supply member.

8. The image forming device according to claim. 1, wherein the developer supply member is disposed vertically beneath the magnetic latent image holding member.

9. A process cartridge, comprising:

a magnetic latent image holding member;

a developer storage unit that stores a liquid developer including a magnetic toner and an aqueous medium; and a developer supply member that supplies the liquid developer to the magnetic latent image holding member, the developer supply member having a surface formed of a liquid absorbent member and being disposed such that a part of the liquid absorbent member is immersed in the liquid developer stored in the liquid developer storage unit and that another part of the liquid absorbent member is in contact with and compressed by the magnetic latent image holding member, the water repellency of the surface of the magnetic latent image holding member being higher than the water repellency of the surface of the developer supply member.

10. The process cartridge according to claim 9, wherein the water retention rate of the liquid absorbent member is higher than about 900%.

11. The process cartridge according to claim 10, wherein the liquid absorbent member is a foam body, a sponge, or a nonwoven fabric.

12. The process cartridge according to claim 9, wherein the surface of the magnetic latent image holding member is subjected to surface coating treatment.

13. The process, cartridge according to claim 9, wherein the contact angle of pure water on the surface of the magnetic latent image holding member is about 70° or more.

14. The process cartridge according to claim 9, wherein the liquid absorbent member is a foam body, a sponge, or a nonwoven fabric; and the contact angle of pure water on the surface of the magnetic latent image holding member is about 70° or more.

15. The image forming device according to claim 1, wherein the developer supply member comprises a single developing roller.

16. The image forming device according to claim 1, wherein the magnetic latent image forming unit comprises a magnetic head.

* * * * *